United States Patent [19]

Jenkins

[11] 4,170,168

[45] Oct. 9, 1979

[54] LOADER/BACKHOE HYDRAULIC SYSTEM AND CONTROL VALVE ASSEMBLY THEREFOR

[75] Inventor: Kenneth E. Jenkins, Peoria, Ill.

[73] Assignee: Parker-Hannifin Corporation, Cleveland, Ohio

[21] Appl. No.: 921,205

[22] Filed: Jul. 3, 1978

Related U.S. Application Data

[63] Continuation of Ser. No. 703,105, Jul. 6, 1976, abandoned.

[51] Int. Cl.[2] ..... F15B 11/16; F15B 15/26

[52] U.S. Cl. ..... 91/522; 91/427; 91/448; 91/453; 91/531; 180/77 S; 414/694

[58] Field of Search ..... 91/444, 448, 464, 526, 91/530, 531, 427, 453, 522; 180/77 S, 66 R; 137/596; 214/138 R, 762; 60/484

[56] References Cited

U.S. PATENT DOCUMENTS

| | | | |
|---|---|---|---|
| 3,175,580 | 3/1965 | Krehbiel | 91/531 |
| 3,211,065 | 10/1965 | Hunger | 91/448 |
| 3,257,013 | 6/1966 | Arnold | 214/131 |
| 3,512,453 | 5/1970 | Balzer | 91/414 |
| 3,768,367 | 10/1973 | Fuzzell | 91/414 |
| 3,944,035 | 3/1976 | McRay | 60/484 |
| 3,966,065 | 6/1976 | Jones | 214/138 R |

*Primary Examiner*—Abraham Hershkovitz
*Attorney, Agent, or Firm*—Maky, Renner, Otto & Boisselle

[57] ABSTRACT

A loader/backhoe hydraulic system and control valve assembly therefor characterized in that each of a plurality of directional control valves is operative through an associated selector valve to control the operation of either of a pair of cylinders connected to said selector valve. The loader/backhoe herein is further characterized in that the control valve assembly and oil tank are unitized and mounted under the floor of the tractor for simplified piping and access for servicing.

2 Claims, 3 Drawing Figures

LOADER/BACKHOE HYDRAULIC SYSTEM AND CONTROL VALVE ASSEMBLY THEREFOR

This is a continuation of application Ser. No. 703,105, filed July 6, 1976, abandoned.

BACKGROUND OF THE INVENTION

In known loader/backhoe equipment there are as many directional control valves as there are cylinders and when the loader boom and bucket directional control valves are in use, the remaining cylinders and directional control valves are idle, and similarly when the backhoe boom, dipper, bucket and swing directional control valves are in use, the loader boom and bucket directional control valves and the stabilizer directional control valves are idle, the latter having already been operated to set the stabilizers in ground-engaging position.

Accordingly, in known loader/backhoe or like dual hydraulic systems, it is quite expensive, not only from the standpoint of numbers, to include as many directional control valves as there are functions, but especially in those cases where the directional control valves incorporate therein load check valves, overload relief valves, makeup check valves, and/or pressure compensators.

SUMMARY OF THE INVENTION

In contradistinction to known loader/backhoe or like dual hydraulic systems, the present invention embodies simple selector valves which are downstream of respective directional control valves and each of which is operative to select either one of two cylinders for operation by the respective directional control valve thereby greatly decreasing the number of directional control valves required in such dual hydraulic system.

It is another object of this invention to provide a simple and compact control valve assembly for a hydraulic system of the character indicated wherein a unitary housing contains a plurality of directional control valve members and corresponding selector valve members together with load check valves, overload relief valves, makeup check valves, and/or pressure compensators.

It is another object of this invention to provide a unitized control valve assembly and oil tank which is mounted under the floor board of a loader/backhoe tractor for simplified piping and for convenient access for servicing or replacement.

DETAILED DESCRIPTION OF A PREFERRED EMBODIMENT

Figure 1:
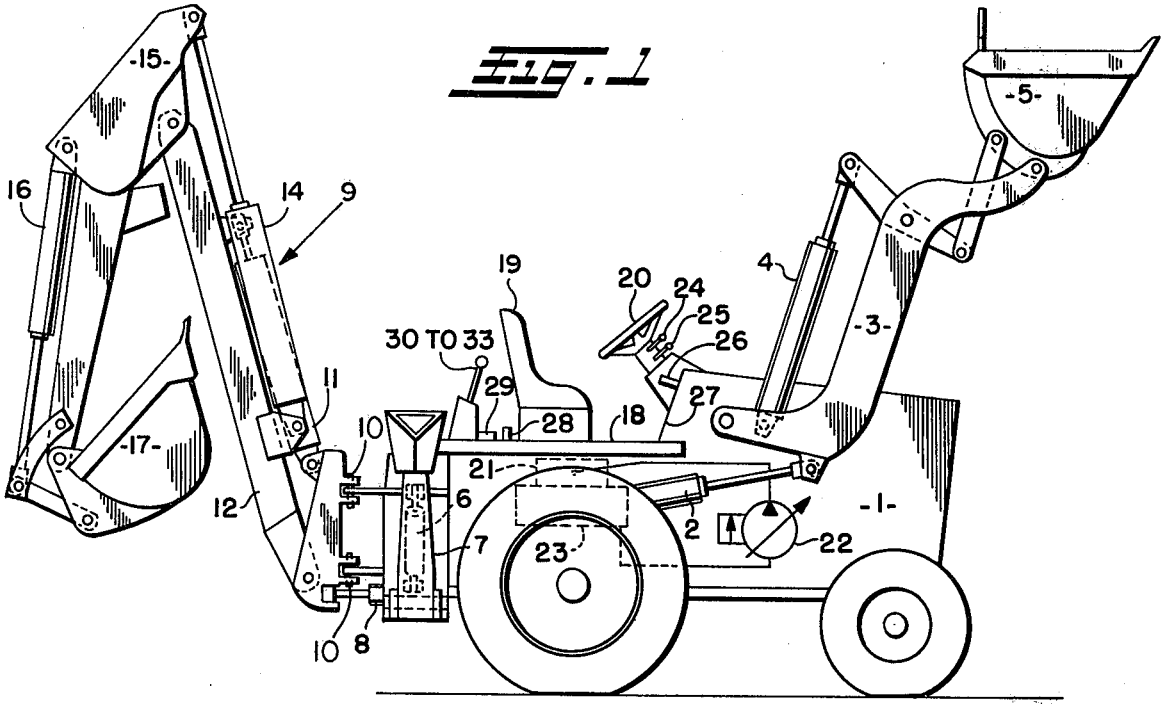
FIG. 1 is a side elevation view of a loader/backhoe embodying the hydraulic system and control valve assembly therefor constituting the present invention.

Referring first to FIG. 1, the loader/backhoe is generally of well-known form including a tractor 1 having an actuating cylinder 2 for raising and lowering the loader boom 3 and an actuating cylinder 4 for actuating the loader bucket 5 between load holding and dumping positions.

Insofar as the backhoe portion of the equipment is concerned there is included a pair of stabilizer cylinders 6, one on each side of the tractor for movement of the stabilizers 7 to and from grounding-engaging position, a swing cylinder 8 for pivoting the backhoe assembly 9 about the vertical pivots 10, an actuating cylinder 11 for raising and lowering the backhoe boom 12, an actuating cylinder 14 for actuating the dipper stick or crowd arm 15, and an actuating cylinder 16 for actuating the backhoe bucket or scoop 17.

The loader/backhoe has an elevated floor 18 on which an operator's seat 19 is mounted behind steering wheel 20 to face forwardly as shown when the loader boom 3 and bucket 5 are being operated. The seat 19 is arranged to be shifted to face rearwardly when the operator desires to set the stabilizers 7 to ground-engaging position and to operate the backhoe swing, boom, dipper and bucket cylinders 8, 11, 14 and 16.

The control valve assembly 21 for controlling the operation of the aforesaid cylinders is preferably mounted on the top of a tank 23, and said valve 21 and tank 23 assembly is preferably disposed beneath the floor 18 for ready access for servicing. Within the tractor 1 is a pump 22 operatively connected to the valve assembly 21 and to the tank 23 as shown.

The loader boom and bucket controls 24 and 25 are preferably mounted on the steering column and the loader selector control 26 is preferably mounted on the dashboard 27. Referring to the backhoe controls, the stabilizer selector control 28 is mounted on the floor 18 and the stabilizer controls 29 are preferably foot-operated to set the respective left and right stabilizers 7 to ground-engaging position or to raise them to generally vertical position as shown in FIG. 1. The backhoe swing, boom, crowd arm and bucket controls 30 to 33 are mounted in a row for convenient operation by the operator when the seat 19 is positioned to face rearwardly.

Figure 2:
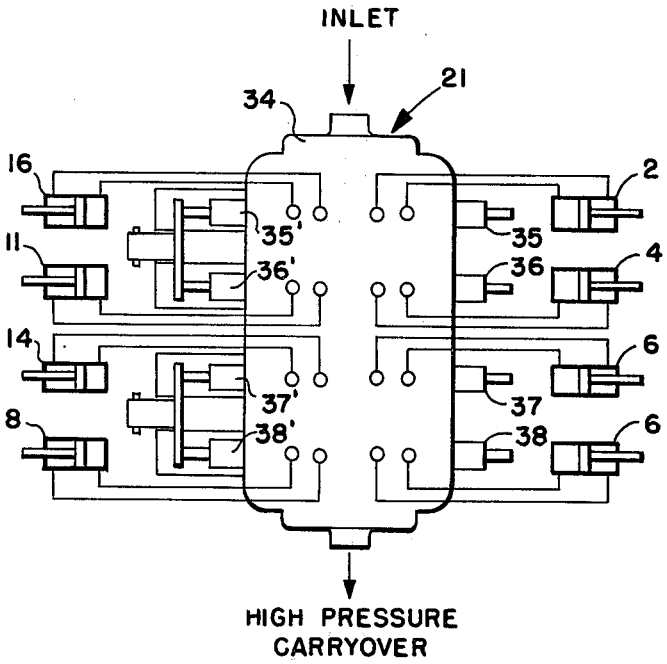
FIG. 2 is a top plan view of the control valve assembly schematically showing the connections of the pairs of selector valve ports connected to the loader/backhoe cylinders.

The control valve assembly 21 comprises a housing 34 having therein four directional control valves 35 to 38 and four selector valves 35′ to 38′. Said housing 34 also has two pairs of ports for each selector valve, said pairs of ports being connected to respective pairs of cylinders as shown in FIG. 2.

The selector valves 35′, 36′, 37′ and 38′ are two-position valves (see FIG. 3) which are spring-biased to communicate the respective backhoe bucket, boom, dipper and swing cylinder ports with the motor passages of the respective directional control valves 35 to 38 and which are held in detent position to communicate the loader boom and bucket stabilizer cylinder ports with the motor passages of the respective directional control valves 35 to 38.

Figure 3:
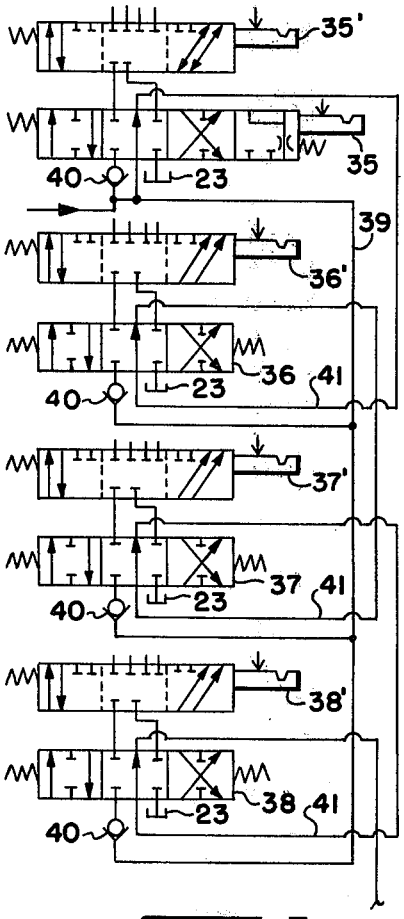
FIG. 3 is a schematic diagram of the FIG. 2 control valve assembly showing the several directional control valves and associated selector valves.

The dashboard loader selector control 26 when pulled simultaneously operates the selector valves 35′ and 36′ to detent position whereby the operation of the directional control valves 35 and 36 by the steering column controls 24 and 25 effects desired control of the loader boom 3 and loader bucket 5. As shown in FIG. 3, the directional control valve 35 for the loader boom 3 has a fourth position which is a float position in which the ports of cylinder 2 are communicated with each other and have restricted communication with the tank 23. When the selector valve 35′ is in its spring-biased position, the operation of the directional control valve 35 by lever 33 will control the operation of the backhoe scoop cylinder 16 and, of course, the lever 33 will be arranged so as not to shift the directional control valve 35 to the float position.

The remaining directional control valves 36, 37 and 38 may be of the four-way three-position type as shown in FIG. 3 and as apparent when the dashboard control 26 is shifted to loader selector position, the operation of the directional control valve 36 will, through cylinder 4, cause movement of the loader bucket 5 between load holding and dumping positions.

Now if it be desired to operate the backhoe implements, the dashboard control 26 is shifted to release the selector valves 35' and 36' from detent-held position to spring-biased position for control of the backhoe bucket and boom cylinders 16 and 11 by operation of levers 33 and 32 for the directional control valves 35 and 36. However, before operating any of the backhoe implements, the stabilizer selector control 28 is actuated to simultaneously move the selector valves 37' and 38' to detent-held position in which the operation of the directional control valves 37 and 38 by the foot pedals 29 actuates the cylinders 6 for movement of stabilizers 7 to ground-engaging position. When that has been accomplished, the control 28 is shifted to release the detents of selector valves 37' and 38' for movement of the latter to their normal spring-biased positions whereby the operation of the directional control valves 37 and 38 by levers 31 and 30 control the actuation of the dipper and swing cylinders 14 and 8.

Each of the directional control valves 35, 36, 37, and 38 has dual operating means 24–33, 25–32, 29–31, and 29–30 respectively. Moreover, the selector valves 35' and 36' are simultaneously actuated by the control 26 to select for operation the loader motors 2 and 4 or the backhoe motors 16 and 11 by the directional control valves 35 and 36, and the selector valves 37' and 38' are simultaneously actuated by the control 28 to select for operation the stabilizer motors 6 or the backhoe motors 14 and 8 by the directional control valves 37 and 38.

As shown in FIG. 2, the operation of the stabilizer selector control 28 simultaneously shifts the selector valves 37' and 38' to stabilizer selector position and, likewise, when the control 28 is operated to release the detents of selector valves 37' and 38', the selector valves 37' and 38' are spring-biased to communicate the motor passages of directional control valves 37 and 38 with the respective pairs of ports connected to the dipper and swing cylinders 14 and 8.

In FIG. 3, the directional control valves 35 to 38 are connected together for parallel operation and if series-parallel operation is desired the passage 39 is omitted and the load check valves 40 for valves 36, 37 and 38 will be connected to the bypass passages 41 as in the case of load check valve 40 for valve 35.

In summary, the control valve assembly 21 herein employs but four directional control valves 35 to 38 to control the operation of eight cylinders by employing simple two-position selector valves 35' to 38' in association with the respective directional control valves 35 to 38 to select certain cylinders for operation. The invention therefore enables the achievement of considerable economies especially when the directional control valves 35 to 38 embody load check valves 40, overload relief valves (not shown), makeup check valves (not shown) and/or pressure compensators (not shown).

The embodiments of the invention in which an exclusive property or privilege is claimed are defined as follows:

1. A valve assembly for a loader/backhoe having loader boom and bucket fluid motors and backhoe bucket, boom, dipper, swing and stabilizer fluid motors comprising a housing having inlet, return, and pairs of motor passages respectively adapted to be communicated with a fluid pressure source, a tank, and said motors; selector valve members movable in said housing from a position communicating the pairs of loader boom and bucket and stabilizer motor passages with respective pairs of fluid passages in said housing to a position communicating the backhoe bucket, boom, dipper and swing motor passages with said respective pairs of fluid passages; directional control valve members upstream of the respective selector valve members movable in said housing to selectively communicate the passages constituting the respective pairs of fluid passages with said inlet and return passages; dual operating means at spaced apart locations remote from said housing for moving each directional control valve member as aforesaid from one location or the other; the operating means for the control of the loader boom and bucket motors being adjacent to one another and the operating means for the control of the backhoe bucket, boom, dipper, swing, and stabilizer motors being adjacent to one another; first means providing for simultaneous movement of two of said selector valve members so that the associated directional control valve members control operation of said loader boom and bucket motors or of two of said backhoe bucket, boom, boom, dipper and swing motor; and second means providing for simultaneous movement of two other selector valve members; said two other selector valve members in the aforesaid positions and associated directional control valve members controlling operation of two stabilizer motors or of the remaining two of said backhoe bucket, boom, dipper and swing motors.

2. The valve assembly of claim 1 wherein said two selector valve members and said two other selector valve members have detent-held positions whereat the associated directional control valve members control operation of said loader bucket and boom motors and said two stabilizer motors; said two selector valve members and said two other selector valve members being released from detent-held positions by said first and second means to spring-biased positions whereat the associated directional control valve members control operation of said backhoe bucket, boom, dipper and swing motors.

* * * * *